United States Patent [19]

Bouteille

[11] 4,167,200

[45] Sep. 11, 1979

[54] DISTRIBUTION DEVICE FOR A PNEUMATIC INSTALLATION

[75] Inventor: Daniel Bouteille, Marnes-la-Coquette, France

[73] Assignee: La Telemechanique Electrique, France

[21] Appl. No.: 783,634

[22] Filed: Apr. 1, 1977

[30] Foreign Application Priority Data

Apr. 2, 1976 [FR] France ..... 76 0968

[51] Int. Cl.[2] ..... F15B 13/04

[52] U.S. Cl. ..... 137/884; 137/596; 137/855

[58] Field of Search ..... 137/533.19, 543.19, 137/596, 625.69, 884, 855; 251/367

[56] References Cited

U.S. PATENT DOCUMENTS

| | | | |
|---|---|---|---|
| 2,538,928 | 1/1951 | Wood | 137/625.69 X |
| 3,215,158 | 11/1965 | Bass et al. | 137/625.69 X |
| 3,234,963 | 2/1966 | Lyon | 251/367 X |
| 3,509,904 | 5/1970 | Olson | 137/884 X |
| 3,513,876 | 5/1970 | Tarbox | 137/596 |
| 3,718,159 | 2/1973 | Tennis | 137/596.13 X |
| 3,722,543 | 3/1973 | Tennis | 137/596.13 X |
| 3,773,074 | 11/1973 | Miceii | 137/596 |
| 3,854,496 | 12/1974 | Broszeit | 137/543.19 |
| 3,881,512 | 5/1975 | Wilke | 137/596.13 |

FOREIGN PATENT DOCUMENTS

| | | | |
|---|---|---|---|
| 357976 | 12/1961 | Switzerland | 137/625.69 |
| 204080 | 10/1967 | U.S.S.R. | 137/596 |

*Primary Examiner*—Gerald A. Michalsky
*Attorney, Agent, or Firm*—Staas & Halsey

[57] ABSTRACT

Improved distribution device constituted by a base and a distributor associated therewith, having internal channels in which the pneumatic fluid circulates normally only in one direction. At least one of these channels possesses a non-return valve disposed near the surface connecting the base and the distributor, allowing the circulation of the fluid in the one, normal direction of circulation. The invention finds interesting application in the domain of pneumatic installations.

12 Claims, 10 Drawing Figures

DISTRIBUTION DEVICE FOR A PNEUMATIC INSTALLATION

BACKGROUND OF THE INVENTION

The present invention relates to an improved distribution device for a pneumatic installation.

SUMMARY OF THE PRIOR ART

To specify the problem which the invention intends to solve, reference will be made to FIGS. 1 and 2 of the accompanying drawings, which are simplified diagrams of a pneumatic installation. FIG. 1 shows an installation which comprises two receivers, in the present case double-acting rams 1 and 2. Each of the chambers of these rams 1*a*, 1*b* and 2*a*, 2*b* is connected in conventional manner to a pressurised fluid inlet conduit 3, said fluid coming from a source (not shown), and to a common exhaust conduit 4 via distributors 5 and 6, which establish, in known manner, selective communications between the chambers and the conduits 3 and 4. It will be noted that the ram 1 is shown to be intentionally much larger than ram 2. In fact, it is not rare in a pneumatic installation to have receivers of very different capacities connected to a common source of pressure.

When distributor 5 is actuated to reverse the distribution of the pressurised fluid in chambers 1*a* and 1*b*, two simultaneous, transitory phenomena are provoked, on the one hand the creation of a counter-pressure in the conduit 4 coming from the exhaust of the air contained in chamber 1*b* and on the other hand a momentary drop in pressure in the conduit 3 coming from the supply of large-capacity chamber 1*a*. Via the distributor 6 and conduits connecting the ram 2 to the conduits 3 and 4, the counter-pressure existing in conduit 4 is transmitted to chamber 2*b* of the ram 2 and the drop in pressure recorded in the conduit 3 brings about a drop in pressure of the fluid contained in the chamber 2*a* of the same ram. It follows that, during this transistory period, the force applied to the piston of the ram 2 is clearly reduced and if this ram 2 is provided to ensure, for example, a tightening or holding under a determined effort, the diminution of this effort may bring about serious technical hitches in the functioning of the installation.

This drawback is remedied, at least partially, by providing a source of pressure and conduits 3 and 4 which are overdimensioned with respect to the overall need of the installation, this of course affecting its cost and bulk. This displacement of the piston may also be slowed down in order to minimise the dynamic effect of the moving air, but this is not always possible nor compatible with the performances required for the installation. A solution to this problem is also known, at least from the theoretical standpoint, which consists in disposing, as shown in FIG. 2, non-return valves such as 7 and 8 in each of the conduits connecting the receivers 1 and 2 to conduits 3 and 4. This systematic solution presents the practical drawback of being expensive, tedious and complex; in fact, it is used only partially at spots where really necessary, this obliging the user to seek these key spots and not reducing the complexity of execution thereof.

To avoid the effects of the counter-pressure due to exhaust, it is sufficient not to connect the exhausts together by a common collector such as 4. The exhaust is then effected in the open air, if necessary through a silencer to avoid noise. However, the fight against air-pollution in workshops by the lubricating oil of the pneumatic devices of the installation in suspension in the compressed air, finds an efficient solution in devices with exhaust connected and led for example to a drain. To conciliate these anti-pollution demands and the good operation of the installation, a solution must be employed such as the one shown in FIG. 2 with all the disadvantages that it comprises.

Furthermore, there is an increasing development of pneumatic installations rationally employing compact components such as in particular distributors which may possibly be assembled in series. These series-installations generally comprise a common pressure supply conduit and one or two common exhaust conduits. These installations therefore present the drawbacks of the type shown in FIG. 1 and the compactness of such an installation precludes solutions employing over-dimensioned conduits to obviate these drawbacks. In addition, in these systems, it is impossible to introduce conventional non-return devices such as 7 and 8 shown in FIG. 2.

Finally, an installation of the type of FIG. 1 has considerable drawbacks when the exhaust counter-pressure of a receiver such as 2 is used for verifying its end of stroke. In fact, in certain machines, it is impossible to dispose pneumatic or electromechanical systems for detecting end of stroke, this then being ensured when the complete drop of the exhaust counter-pressure in the ram is recorded. This recording results in the control of a device, generally a relay, whose energization constitutes the authorization to carry out other operational sequences of the machine. It is clearly seen that untimely counter-pressures such as those produced by the ram 1 may be recorded at the level of ram 2 and may lead to parasitic signals in the control circuit of this ram.

Finally, it will be noted that certain distributors are sensitive to certain variations in pressure, particularly exhaust counter-pressures concomitant with drops in pressure in the fluid inlet conduit and may change state under the effect of these parasitic influences.

SUMMARY OF THE INVENTION

It is an object of the present invention to remedy these drawbacks by proposing an improved distribution device for a pneumatic installation, comprising, in integrated manner, simple non-return valves which are easy to manufacture, do not affect the performances of the installation and do not require any intervention from the user for their use which intervenes automatically with the execution of the main function of distribution. To this end, the device is constituted by a distributor cooperating with an inlet and outlet base for the fluid to be distributed by maintaining in contact with each other corresponding connection surfaces carried by the distributor and the base, via a seal. The surface carried by the base is provided with orifices connected by conduits inside the base, in known manner, to a pressurised fluid supply orifice, to at least one exhaust orifice and to at least one outlet orifice adapted to be connected to a receiver. The surface carried by the distributor is provided with orifices located opposite the above-mentioned orifices, connected together in known manner by conduits inside the distributor. The device thus presents internal channels through which the pneumatic fluid normally passes in one direction only and internal channels through which it normally passes in the two directions. According to the invention, at least one of the internal channels through which the pneumatic fluid passes in one direction is equipped, near the connection of the base and the distributor, with a non-return valve allowing the free passage of the fluid in the normal direction of its circulation.

Each of the internal channels through which flows a fluid from the distributor to the base is equipped with said non-return valve. A variant of this preferred embodiment consists in that each of the internal channels through which passes a fluid from the base to the distributor is also equipped with said non-return valve.

In a preferred embodiment, this non-return valve comprises a valve constituted by a deformable tongue fixed by one of its ends to at least one of the connection surfaces of the distributor and the base, its other end being adapted to move in a housing, open on the side of the connection surface of the distributor or the base in which it is made, and disposed in series in the channel in question which opens therein in the upstream part through a seat on which said tongue is applied in its position of closure, and which issues therefrom through an orifice located downstream of said seat with respect to the normal direction of the circulation of the fluid in the channel, said orifice not being closable by the tongue.

DESCRIPTION OF THE PREFERRED EMBODIMENTS

Figure 1:
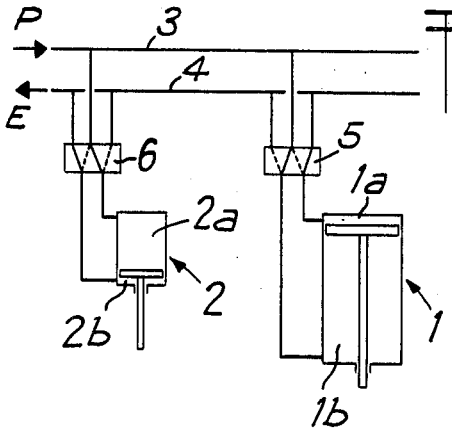
FIG. 1 PRIOR ART
FIGS. 1 and 2 show schematically prior art arrangements.
Figure 2:
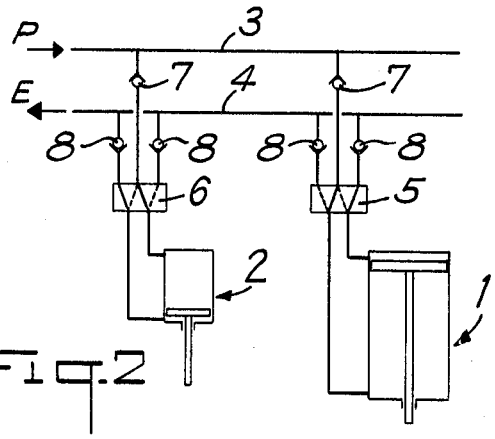
FIG. 2 PRIOR ART
Figure 3:
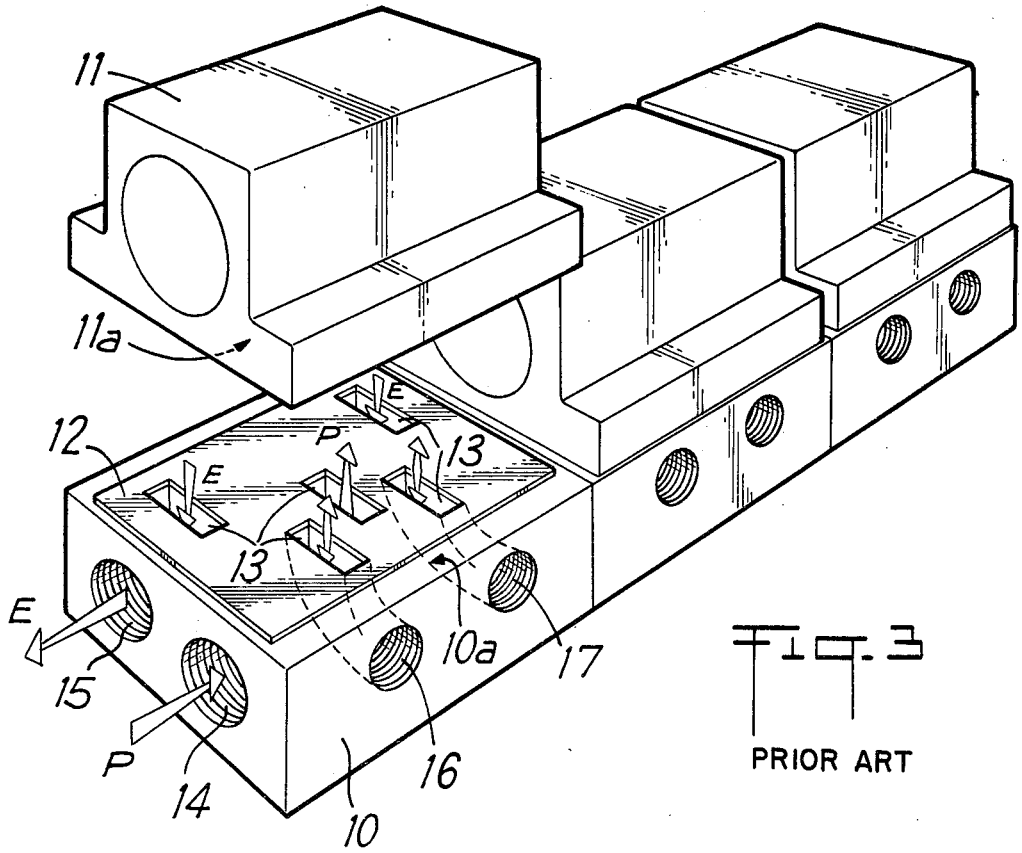
FIG. 3 PRIOR ART
FIG. 3 schematically illustrates a known type of distribution device.

FIG. 3 shows known distribution devices mounted in series. Each of these devices is constituted by a base 10 for the inlet and outlet of the fluid to be distributed and a distributor 11. The cooperation of the base and the distributor is effected by maintaining in contact connection surfaces 10*a* and 11*a* respectively made on the base and the distributor, the tightness of this contact being ensured by a seal 12. The surface 10*a* is provided with orifices 13 connected in known manner by channels inside the base 10, to a pressurised fluid supply orifice 14, an exhaust orifice 15 and to two outlet orifices 16 and 17 adapted to be connected to a receiver. It will be noted that such a base may support variant embodiments depending on the use for which it is intended and in particular may comprise only one outlet orifice such as 16 and two exhaust orifices such as 15. The surface 11*a* of the distributor 11 also comprises orifices (not shown) located opposite orifices 13 in surface 10*a* and interconnected, in known manner, by channels inside the distributor. The assembly of the distributor 11 and the base 10 determines a distribution device which conventionally comprises internal channels through which the pneumatic fluid normally passes in one direction and internal channels through which said fluid passes in the two directions. The arrows indicated in this FIG. 3 illustrate the circulation of the fluid in this device.

Figure 4:
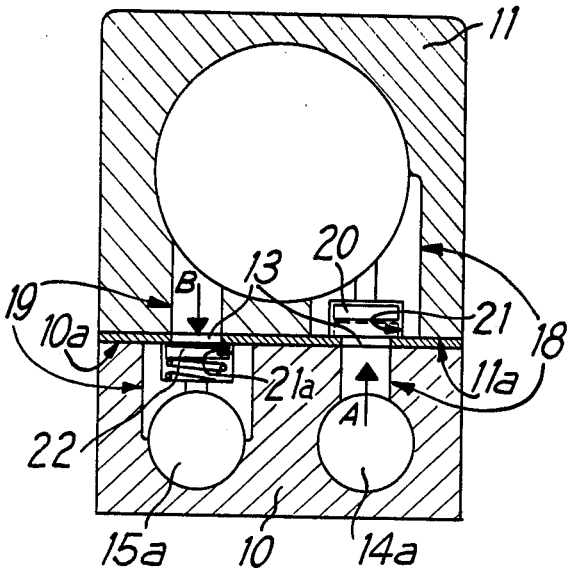
FIG. 4 and 4*a* illustrate a first embodiment of the device according to the invention.
Figure 4A:
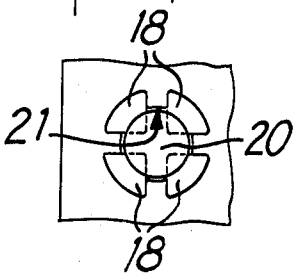

FIG. 4 shows, by a schematic and simplified section, the device according to the invention. This Figure shows certain of the elements which have already been described with reference to FIG. 3, with the same references. This Figure shows a first internal channel 18 through which the pneumatic fluid normally passes in one direction A, from the base to the distributor. It also shows a second internal channel 19 through which the pneumatic fluid normally flows in one direction B, from the distributor to the base. Each of these channels 18 and 19 is equipped with a non-return valve allowing the free passage of the fluid in the normal direction A or B of its circulation. The non-return valve equipping the channel 18 comprises a valve constituted by a mobile pellet 20 mounted to slide freely in a housing 21 open on the surface 11*a* and accessible by said surface. This housing 21 is disposed in series in the channel 18 which opens out in its upstream part with respect to the normal direction of circulation A of the fluid through a seat, here constituted by the edge of the orifice 13, on which may be applied the pellet 20 in its position closing the channel 18. The channel 18 issues from housing 21 downstream of said seat with respect to the direction A laterally, so that the pellet 20 can no longer obturate it as soon as it has left its seat. FIG. 4*a* which is an end view of the housing 21, illustrates the lateral connection of the conduit 18 and the housing. Finally, it will be noted that said pellet 20 extends partially in the conduit 18 in order to present a surface that may undergo the force of a fluid flowing in the direction contrary to the normal direction A allowing it to be entrained in the direction of the seat.

Channel 19 is also equipped with a non-return valve of the same type as the one equipping the channel 18. The latter is constituted by a pellet 22, mounted to slide in a housing 21*a*, of the same type as the housing 21, the pellet 22 being adapted to be applied to a seat disposed in the upstream part of the housing 21*a*, with respect to direction B of circulation of the fluid and which is here constituted by the edge of one of the orifices, the surface 11*a* of which is provided, opposite one of the orifices 13, in order to constitute the internal channel 19.

Finally it will be noted in this Figure that the seal 12 covering the edges of the said orifices constitutes an element for sealing the closure of the non-return valves. The pellets 20 and 22 may thus be made of metal. Insofar as the seal 12 does not cover these edges, said pellets may be imagined to be made of a slightly deformable material in order to ensure this seal.

It is obvious that the mobile elements such as 20 and 22, described hereinabove, may be of shapes which are completely different, without departing from the scope of the invention. They maybe spherical or truncated, etc. . . , the edge of said orifices constituting the seat which in this case may be bevelled. Furthermore, the housing 21 and 21*a*, which are shown here to be made respectively in the body of the distributor and in the body of the base, may equally well be made in one and the other of these elements. In fact, it suffices that the channels 18 and 19 open into the upstream part of these housings with respect to direction A, B of normal circulation of the fluid, through a valve seat. Finally, it is obvious that elastic return members, for example springs, may be disposed in housing 21 and 21*a*, tending to apply the pellets 20 and 22 on their respective seat.

In operation, the channel 18 is connected to a source of pressure via a conduit 14*a* issuing from orifice 14. Similarly, channel 19 is connected to the exhaust orifice 15 via a conduit 15*a*. The normal circulation of fluid in the channel 18, which is indicated by arrow A, disengages the pellet 20 from its seat and allows a free transfer of the fluid from conduit 14*a* to the bore of the distributor. The same applies to the normal circulation B of the fluid in conduit 19 which disengages the pellet 22 from its seat and allows a free passage of the fluid from the bore of the distributor in conduit 15*a*. If, for one of the reasons set forth in the preamble hereinabove, the pressure drops in conduit 14*a*, the fluid may circulate in the direction opposite direction A indicated. At this moment, it entrains the pellet 20 in the direction of its seat, applying it thereon, and the channel 18 is obturated. If furthermore, a counter-pressure were produced in conduit 15*a*, it would provoke a transfer of fluid in the channel 19 in the direction contrary to direction B and would entrain pellet 22 towards its seat, would apply it thereon and close said conduit 19. The receiver, connected to this distribution device, is isolated from the rest of the installation as soon as a technical hitch either concerning the supply of pressure or concerning the exhaust, occurs.

Figure 5:
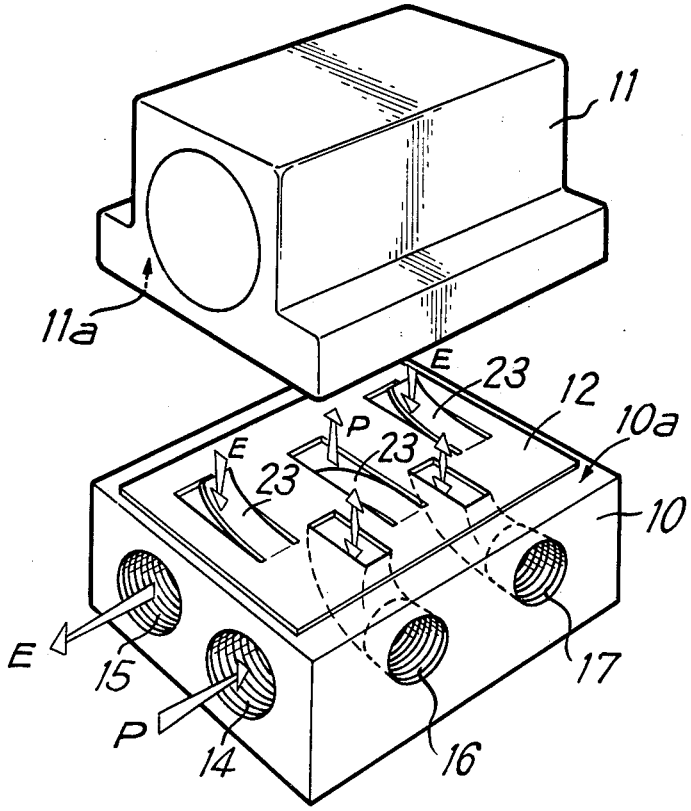
FIG. 5 illustrates a second embodiment of device according to the invention.

FIG. 5 shows certain of the elements which have already been described, with the same references. This Figure shows that the channels through which the pneumatic fluid normally passes in one direction are equipped with non-return valves, constituted by tongues 23. In this case, these tongues are integral with the seal 12 but variant embodiments may include tongues which are independent of this seal and are fixed either on the surface 10*a* of the base 10 or on the corresponding surface 11*a* of the distributor.

Figure 6:
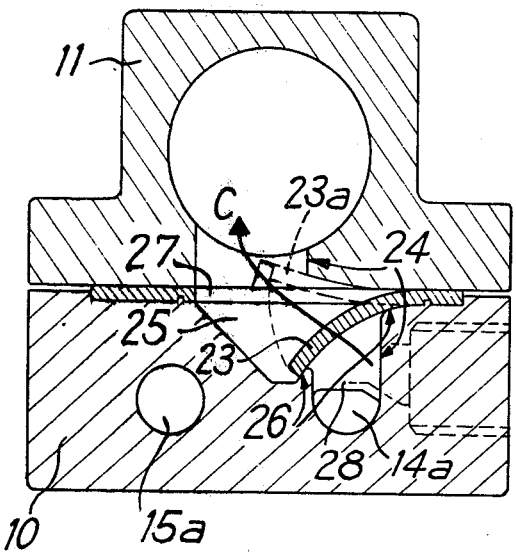
FIGS. 6 and 6*a* on the one hand and 7 and 7*a* on the other hand illustrate details of the embodiment of FIG. 5.
Figure 6A:
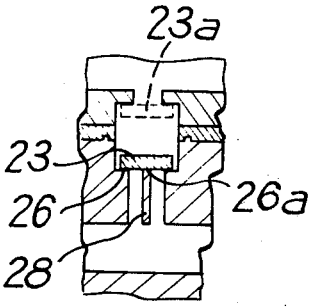

FIG. 6 shows in section the arrangement of one of these tongues in an internal channel 24 through which the pneumatic fluid normally passes in the direction of arrow C. This channel 24 comprises, in fact, in series, a housing 25 for movement of the tongue 23. This housing connects with the channel 24 upstream with respect to the direction C of circulation of the fluid via a seat 26, on which the tongue 23 is shown as being applied. This channel 24 issues from the housing 25 through an orifice 27 and located downstream of said seat with respect to direction C and which is not obturated by the tongue 23. However, in its position 23*a*, the tongue 23 partly obturates this orifice 27 whilst leaving a section of passage for the fluid, at least equal to the nominal section of the device. FIG. 6*a* shows that the seat 26 comprises a central part 26*a* constituted by the upper part of a partition 28 which the channel 24 comprises, in order to support the tongue 23 which is made of deformable material. The position of the tongue 23 in these Figures is the one which it takes naturally when there is no circulation of fluid in the device. In the case of the Figure, this position is ensured by the elastic characteristics which have been given to the tongue, but they may also be ensured by an elastic return member extending for example between the tongue and the distributor 11.

Figure 7:
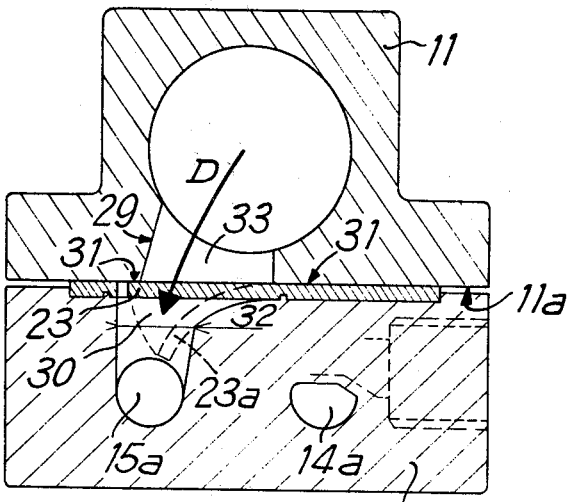
Figure 7A:
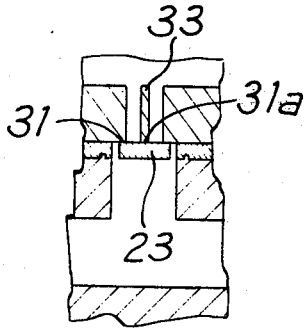

FIG. 7 shows an internal channel 29 through which the pneumatic fluid normally passes in the direction of arrow D. A tongue 23 may move in a housing 30 comprised in series by the channel 29 opening thereinto, upstream with respect to direction D, through a seat 31 here constituted by the portion of surface 11*a* surrounding the orifice connected to the part inside the distributor 11 of the channel 29, and which issues therefrom through an orifice 32 located downstream of said seat with respect to direction D, which orifice is not closable by said tongue. However, in its position 23*a*, said tongue partially obturates this orifice 32, whilst leaving a section of passage for the fluid at least equal to the nominal section of the device. The tongue 23 is shown in FIG. 7 in the position which it occupies under the effect of its own elasticity or under the effect of a return member (not shown) disposed between the base 10 and itself, when no fluid circulates in the device. FIG. 7*a* shows that the seat 31 comprises a central part 31*a* constituted by the outer edge of a partition 33 which the part inside the distributor of channel 29 comprises, in order to support the tongue which is by nature deformable when a pressure presses it on its seat.

FIG. 6 clearly shows that, when the fluid circulates in direction C, its passage is free in channel 24. On the other hand, when a circulation is created in the direction contrary to that of arrow C, particularly following a drop in pressure in conduit 14*a*, this circulation contacts the tongue 23 by its part projecting into the orifice 27, and more generally in the housing 25, and presses it against seat 26. The channel 24 is then closed and this circulation, contrary to normal circulation, cannot continue. Similarly, a circulation of the fluid in direction D is produced further, for example, to the existence of a counter-pressure in conduit 15*a*, this circulation contacts the part of the tongue 23 projecting in the orifice 32 and more generally in the housing 30, and presses it on seat 31. At this instant, the channel 29 is closed and this circulation can no longer continue. Thus, each receiver connected to orifices 16 and 17 of the device according to FIG. 5 is therefore isolated from the rest of the installation, as soon as a technical hitch occurs therein.

The device according to the invention may be used alone in an installation. In this case, it has the advantage of offering the user a function of security, apart from the function of distribution which it normally assures, without the user being preoccupied in executing this function. This comes from the fact that this non-return function, assured in the exhaust and pressure supply channels, is perfectly integrated in the device, particularly rendering the free valves which may be employed sure. Another advantage resides in the fact that this equipment which, by its design, is of a cost price substantially equal to the cost price of a conventional distribution device, makes it possible to economise by buying and installing separate non-return valves.

The device according to the invention is also suitable for assembly in series. In fact, by eliminating the necessity of overdimensioning certain conduits of the installation, as set forth hereinabove, it allows the miniaturisation and compactness thereof, this being one of the main conditions to be fulfilled in equipment intended for assembly in series. Moreover, it solves all the problems of intercommunication and of elimination of parasitic signals which are especially encountered in installations applying the assembly in series, in which the exhaust is generally collected, without the user being preoccupied with this. Finally, this double advantage is obtained very competitively with existing equipment.

What is claimed is:

1. An improved distribution device for a pneumatic installation comprising: a distributor, an inlet and outlet base for distributed fluid, cooperating with said distributor by maintaining contact therewith by corresponding substantially flat connection surfaces on the distributor and on the base, a seal between said corresponding flat connection surfaces, the flat connection surface on the base being provided with orifices connected to conduits inside the base which are connected to a pressurized fluid supply orifice, to at least one exhaust orifice, and to at least one outlet orifice adapted to be connected to a receiver, the flat connection surface on the distributor being provided with orifices and interconnected by conduits inside the distributor, the device thus presenting by means of said conduits internal channels through which pneumatic fluid normally passes in one direction and internal channels through which it normally flows in two directions, wherein at least one of the internal channels through which the pneumatic fluid normally passes in one direction, is equipped, substantially at the surface common to the base and to the distributor, with a non-return valve allowing the free passage of the fluid in the normal direction of its circulation.

2. The device as defined in claim 1, wherein each of the internal channels through which a fluid normally passes from the distributor to the base is equipped with said non-return valve.

3. The device as defined in claim 1, wherein each of the internal channels through which a fluid normally flows from the base to the distributor is equipped with said non-return valve.

4. The device as defined in claim 1, wherein said non-return valve comprises a valve constituted by a mobile element mounted to slide freely in a housing, open on the side of the connection surface of the distributor and the base, in which it is made, and disposed in series in the channel in question, which channel opens in its upstream part through a seat on which said element may be applied, which channel issues therefrom laterally along the part of the housing located downstream of said seat with respect to the normal direction of circulation of the fluid in the channel.

5. The device as defined in claim 4, wherein said mobile element extends partially in the portion of channel adjacent said housing and in lateral communication therewith.

6. The device as defined in claim 4, wherein the seat is constituted by an edge of the orifice provided in the connection surface of the distributor and the base located opposite the said opening of the housing.

7. The device as defined in claim 6, wherein the said edge is covered by the seal of the distributor base assembly which ensures the seal of the non-return valve in its closed position.

8. The device as defined in claim 4, wherein the valve member of the non-return valve is coupled to an elastic return member, the effect of which tends to press said valve on its seat.

9. The device as defined in claim 8, wherein, when the valve member is a tongue, the elastic return member is constituted by the tongue itself which is made of elastic material.

10. The device as defined in claim 1, wherein each non-return valve comprises a valve constituted by a deformable tongue fixed by one of its ends to at least one of the connection surfaces of the distributor and the base, its other end being adapted to move in a housing, open on the side of the connection surface of the distributor or the base in which it is made and disposed in series in the channel in question which opens therein in the upstream part through a seat on which said tongue is applied in its position of closure, and which issues therefrom through an orifice located downstream of said seat with respect to the normal direction of circulation of the fluid in the channel, which orifice is not closable by the tongue.

11. The device as defined in claim 10, wherein the tongue may partially obturate the downstream orifice whilst leaving a section of passage at least equal to the nominal section of the apparatus free.

12. The device as claimed in claim 10, wherein the tongue is integral with the seal of the base-distributor assembly.

* * * * *

UNITED STATES PATENT AND TRADEMARK OFFICE

CERTIFICATE OF CORRECTION

PATENT NO. : 4,167,200

DATED : September 11, 1979

INVENTOR(S) : DANIEL BOUTEILLE

It is certified that error appears in the above-identified patent and that said Letters Patent are hereby corrected as shown below:

Col. 1, line 28, "transitory" should be --transistory--.

Col. 3, line 31, "FIG." should be --FIGS.--.

Signed and Sealed this

*Eighth* Day of *January 1980*

[SEAL]

*Attest:*

SIDNEY A. DIAMOND

*Attesting Officer*

*Commissioner of Patents and Trademarks*